US006763748B2

(12) United States Patent
Wolcott et al.

(10) Patent No.: US 6,763,748 B2
(45) Date of Patent: Jul. 20, 2004

(54) AUTOMATIC DRAFT LENGTH COMPENSATION FOR SLICING MACHINE SYSTEM

(75) Inventors: Thomas C. Wolcott, Mokena, IL (US); Glenn Sandberg, Mokena, IL (US)

(73) Assignee: Formax, Inc., Mokena, IL (US)

( * ) Notice: Subject to any disclaimer, the term of this patent is extended or adjusted under 35 U.S.C. 154(b) by 0 days.

(21) Appl. No.: 10/206,881

(22) Filed: Jul. 26, 2002

(65) Prior Publication Data

US 2004/0016331 A1 Jan. 29, 2004

(51) Int. Cl.[7] ..... B26D 7/06; B26D 5/20

(52) U.S. Cl. ..... 83/29; 83/76.8; 83/88; 83/155; 83/358; 83/360; 83/932

(58) Field of Search ..... 83/29, 932, 77, 83/78–166, 76.8, 155, 360, 358, 88; 414/798.2; 198/418.9, 418.3, 418.4; 53/435, 517, 447, 540, 504

(56) References Cited

U.S. PATENT DOCUMENTS

| | | | | |
|---|---|---|---|---|
| 3,846,958 A | | 11/1974 | Divan | |
| 3,948,153 A | | 4/1976 | Dutro et al. | |
| 3,965,783 A | | 6/1976 | Muller et al. | |
| 4,018,326 A | | 4/1977 | Hardy | |
| 4,120,393 A | | 10/1978 | Motooka et al. | |
| 4,135,616 A | | 1/1979 | Pellaton | |
| 4,280,614 A | | 7/1981 | Balch et al. | |
| 4,545,179 A | * | 10/1985 | Rebsamen et al. | 53/443 |
| 4,557,019 A | | 12/1985 | Van Devanter et al. | |
| 4,962,568 A | | 10/1990 | Rudy et al. | |
| 5,022,644 A | * | 6/1991 | Burge | 271/270 |
| 5,095,684 A | * | 3/1992 | Walker et al. | 53/443 |
| 5,097,939 A | | 3/1992 | Shanklin et al. | |
| 5,125,303 A | * | 6/1992 | Hoyland | 83/76.8 |
| 5,137,139 A | | 8/1992 | Ruscello | |
| 5,481,466 A | | 1/1996 | Carey | |
| 5,649,463 A | | 7/1997 | Lindee et al. | |
| 5,704,265 A | | 1/1998 | Johnson et al. | |
| 5,974,925 A | | 11/1999 | Lindee et al. | |
| 6,050,060 A | * | 4/2000 | Spatafora et al. | 53/447 |

FOREIGN PATENT DOCUMENTS

| | | |
|---|---|---|
| EP | 0 504 466 A1 | 9/1992 |
| EP | 0 713 753 | 5/1996 |
| FR | 2 492 783 | 4/1982 |
| GB | 2 149 650 B | 8/1986 |
| WO | WO 93/24287 | 12/1993 |
| WO | WO 99/08844 | 2/1999 |

OTHER PUBLICATIONS

US 2003/0145560 A1 (Melville) Aug. 2003, para. [0031], [0032].*

Formax Inc., Variety Pack, Aug. 22, 2000, 8 pages.

* cited by examiner

*Primary Examiner*—Allan N. Shoap
*Assistant Examiner*—Issac N Hamilton
(74) *Attorney, Agent, or Firm*—The Law Office of Randall T. Erickson, P.C.

(57) ABSTRACT

A slicing and conveying system forms a three or more flavor-combined draft. A first slicing machine slices a succession of first and third slices in first and third shingled drafts. A second slicing machine slices a succession of second slices in second shingled drafts. A pass-through conveyor transfers the first draft to an output conveyor of the second slicing machine, wherein the second draft is added to the first draft to form a first combined draft. An overlap conveyor receives the first combined draft and merges the first combined draft with the third draft on the overlap conveyor to form an elongated combined draft. Optical sensors determine lengths of the first draft, the second draft, the third draft, and/or the elongated combined draft. A control receives input from the sensors and outputs a control signal to one or more output conveyors of the slicing machine and/or the overlap conveyor to adjust the spacing of the slices within the first, second and third drafts and/or to control the length of the elongated combined draft.

19 Claims, 8 Drawing Sheets

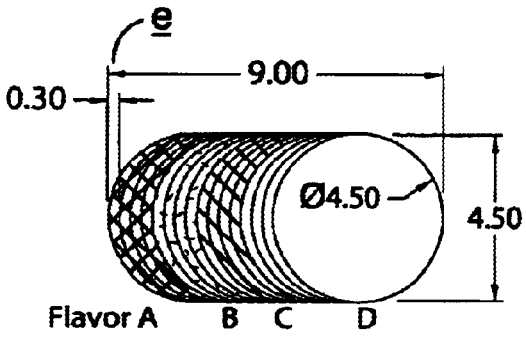

16 slices of round product spaced at .3" apart will give a 9" draft length.

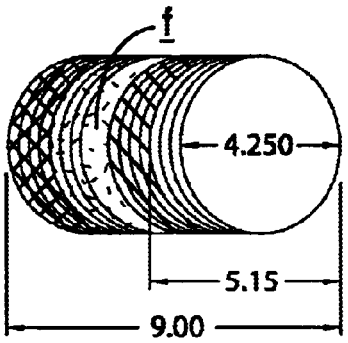

If the product is oval (4.25 x 4.75) and the .3" space is maintained, then an un-acceptible gap occurs while maintaining the 9"overall length.

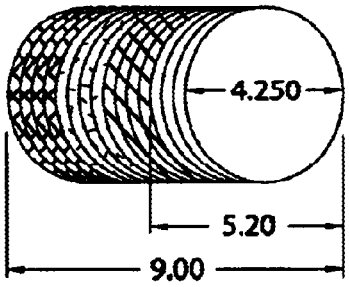

If the product is oval (4.25 x 4.75), the .3" space may be adjusted to .317" and the 9" overall length will be maintained.

However;

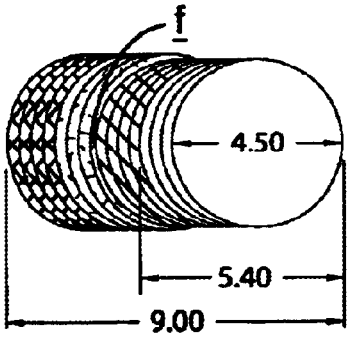

If some product returns to round then the gap becomes too small, or the draft length becomes too long.

FIG. 8

AUTOMATIC DRAFT LENGTH COMPENSATION FOR SLICING MACHINE SYSTEM

TECHNICAL FIELD OF THE INVENTION

The invention relates to slicing and conveying systems for food products.

BACKGROUND OF THE INVENTION

Slicing machines and associated conveyors are known that cut slices from food loaves and deposit the slices in a shingled stack or draft on a moving conveyor. Such a machine is described for example in U.S. Pat. Nos. 5,649,463; 5,704,265; 5,974,925; as well as patent publications EP0713753 and WO99/08844.

A system has been developed by Formax, Inc. of Mokena, Ill., U.S.A. wherein a rear slicing machine simultaneously slices a pair of loaves of different flavors, flavors A and C, to form two shingled drafts that are then delivered by a pass-through conveyor through a rear entrance of a front slicing machine. The front slicing machine slices a pair of loaves of different flavors, flavors B and D, to form two shingled drafts which are deposited directly on the shingled drafts of the A and C flavors that were transported to the second slicing machine by the pass-through conveyor. Thus, a pair of combined drafts of four flavors A+B and C+D is formed. The combined drafts of flavors A+B and C+D are transported to an overlap conveyor which routes the C+D draft behind the A+B draft to form an elongated combined draft of flavors A, B, C, D. The flavors A, B, C, D can be different types of meats, such as ham and bologna, or cheeses, such as American and Swiss. This elongated combined draft of flavors A, B, C, D can be packaged as a four flavor variety pack.

Although the above system incorporates two slicing machines that each slice two different flavor loaves to provide a four flavor variety pack, it is also known to provide a three flavor variety pack wherein the rear slicing machine slices two loaves, forming drafts A and C and the front slicing machine slices only one loaf, forming draft B. A two flavor combined draft A, B, formed as described above by both the rear and the front slicing machine, is combined at the overlap conveyor with the single flavor draft C, to form a three flavor elongated combined draft A, B, C.

The present inventors have recognized that the aforementioned system requires adjustments to maintain a consistent overall length of the elongated combined draft. The cause for these adjustments is in part due to product loaves that are not consistently round. Product loaves can be oval or flattened in some manner or vary in diameter from loaf to loaf. A decrease in slice length, with the spacing or slice exposure distance remaining constant will result in a decreased length of the elongated combined draft. An increase in slice length, with the spacing or slice exposure distance remaining constant will result in an increased length of the elongated combined draft.

As illustrated in FIG. 8, sixteen slices of round product spaced at 0.3 inches slice exposure distance will give a 9 inch length of the elongated combined draft. If, however, one of the product flavors becomes oval (length 4.25×width 4.75 inches) and the 0.3 inch space is maintained, then an unacceptable gap f is needed between drafts if the 9 inch overall length of the elongated combined draft is maintained. If the product is oval (length 4.25×width 4.75 inches), the 0.3 inch slice exposure distance may be adjusted to 0.317 inches and the 9 inch overall length of the elongated combined draft will be maintained. However, if the product then returns to round, and the slice exposure distance remains at 0.317 inches, if the 9 inch overall length of the elongated combined draft is maintained, then the gap f becomes too small, or the draft length becomes greater than 9 inches. Given variable loaf profiles, the system must be manually and frequently adjusted to ensure a consistent nine inch draft length and a consistent gap between drafts which make up the elongated combined draft.

The present inventors have recognized that it would be advantageous to provide a slicing and conveying system that could provide a succession of elongated combined drafts comprising drafts of different flavors and wherein each elongated combined draft had a consistent gap between flavor drafts and a consistent overall length. The present inventors have recognized that consistent gap and overall length are important in packaging and overall product appeal to consumers.

SUMMARY OF THE INVENTION

A slicing and conveying system is provided for arranging multi-flavor drafts of slices from two separate slicing machines in an elongated combined draft for packaging in a multi-flavor variety pack. The invention provides a control system for automatically controlling the overall length of the elongated combined draft, and slice and draft spacing within the combined draft.

In accordance with an exemplary embodiment of the invention, a slicing and conveying system for forming a three or more flavor combined draft includes:

- a first slicing machine having a rotating slicing blade operable in an effective first cutting plane, and a loaf feed introducing a first loaf into the first cutting plane to form a succession of first slices;
- a first output conveyor beneath the first slicing machine for receiving the first slices in a first draft;
- a second slicing machine having a rotating slicing a blade operable in an effective second cuffing plane, and a loaf feed introducing a second loaf into the second cutting plane to form a succession of second slices;
- a second output conveyor beneath the second slicing machine for receiving the second slices in a second draft;
- a pass-through conveyor receiving the first draft from the first output conveyor and transferring the first draft to the second output conveyor, wherein the second draft is added to the first draft to form a first combined draft;
- wherein one of the first and second slicing machines comprises a third loaf feed for introducing a third loaf into one of the first and second cutting planes to form a succession of third slices in a third draft; and
- an overlap conveyor arranged downstream of the second output conveyor, wherein the first combined draft is transferred onto the overlap conveyor and combined with the third draft on the overlap conveyor to form an elongated combined draft;
- a first length sensor for determining a length of the first draft from the first slicing machine;
- a second length sensor for determining a length of the second draft from the second slicing machine;
- a third length sensor for determining a length of the third draft; and
- a control receiving input from the first, second, and third length sensors and outputting a control signal to said first and second output conveyors to adjust the spacing of the slices within the first, second and third drafts to control the length of the elongated combined draft.

As a further aspect of the exemplary embodiment of the invention, a combined length sensor can be provided for sensing a length of the elongated combined draft. The combined length sensor can be signal-connected to the control, and the control can be signal-connected to at least one of the conveyors of the overlap conveyor to adjust the spacing of the drafts which are merged on the overlap conveyor, to adjust the overall length of the elongated combined draft.

As a further exemplary aspect of the invention, the first slicing machine comprises the third loaf feed for introducing the third loaf into the first cutting plane, adjacent the first loaf, to form the succession of third slices in the third draft. The second slicing machine comprises a fourth loaf feed for introducing a fourth loaf into the second cutting plane adjacent the second loaf to form a succession of fourth slices in a fourth draft. The third draft is transferred by the pass-through conveyor onto the second output conveyor of the second slicing machine, wherein the fourth draft is added to the third draft to form a second combined draft. An overlap conveyor is arranged downstream of the second output conveyor, wherein the first and second combined drafts are transferred onto the overlap conveyor to form a four-draft elongated combined draft.

According to this exemplary embodiment of the invention, a fourth length sensor is provided for sensing a length of the fourth draft. The control receives input from the first, second, third, fourth and combined length sensors and outputs control signals to the first and second output conveyors, and the overlap conveyor to control the length of, and slice and draft spacing within, the elongated combined draft.

An exemplary method of the invention controls the length of an elongated combined draft of food slices cut by a plurality of slicing machines, and comprises the steps of:

providing a first slicing machine having a rotating slicing blade operable in an effective first cutting plane, and a loaf feed introducing a first loaf into the first cutting plane to form a succession of first slices;

providing a first output conveyor beneath the first slicing machine for receiving the first slices in a first draft;

providing a second slicing machine having a rotating slicing blade operable in an effective second cutting plane, and a loaf feed introducing a second loaf into the second cutting plane to form a succession of second slices;

providing a second output conveyor beneath the second slicing machine for receiving the second slices in a second draft;

providing a pass-through conveyor receiving the first draft from the first output conveyor and transferring the first draft to the second output conveyor, wherein the second draft is added to the first draft to form a first combined draft;

providing that one of the first and second slicing machines comprises a third loaf feed for introducing a third loaf into one of the first and second cutting planes to form a succession of third slices in a third draft;

providing an overlap conveyor arranged downstream of the second output conveyor, the overlap conveyor having merging paths, wherein the first combined draft is transferred onto the overlap conveyor and merged with the third draft on the overlap conveyor to form an elongated combined draft;

sensing a length of the first draft from the first slicing machine;

sensing a length of the second draft from the second slicing machine;

sensing a length of the third draft; and automatically adjusting the speed of at least one of the output conveyors to adjust the length of one of the first, second or third drafts to adjust the length of a succeeding elongated combined draft.

A further aspect of the method comprises the further step of automatically adjusting the relative speed of a crossover conveyor of the overlap conveyor to adjust the length of the elongated combined draft.

A still further aspect of the method comprises the further step of sensing the length of the elongated combined draft and adjusting the speed of at least one of the output conveyors.

A still further aspect of the method comprises the further step of sensing the length of the elongated combined draft and adjusting the relative speed of a crossover conveyor of the overlap conveyor to adjust the length of the elongated combined draft.

A still further aspect of the method comprises the further step of sensing the length of the elongated combined draft and adjusting the relative speed of a crossover conveyor of the overlap conveyor and the speed of at least one of the output conveyors to adjust the length of the elongated combined draft.

According to another aspect of the invention, a slicing and conveying system is provided for arranging slices from a slicing machine in a shingled draft of controlled length. This aspect can be applicable to a single slicing machine or multiple in-line slicing machines as described above. Particularly, a control system is provided for sensing the length of the draft and automatically adjusting the degree of shingling of the slices in a subsequent shingled draft by controlling the speed of an output conveyor which receives the slices from the slicing machine.

According to an exemplary embodiment, a slicing machine having a rotating slicing blade is operable in an effective cutting plane, and a loaf feed introduces a loaf into the cutting plane to form a succession of slices. An output conveyor located beneath the slicing machine receives the slices, the output conveyor movable to create a shingled draft of the slices. A length sensor determines a length of the draft. A control receives input from the length sensor and outputs a control signal to the output conveyor to control the length of the draft.

The output conveyor can comprise a conveying surface circulated by a servomotor and a servomotor drive, the servomotor drive controls the servomotor. The servomotor drive is signal-connected to the control, the control operable to adjust the speed of the conveying surface.

The length sensor can comprise an optical detector arranged above the conveying surface which senses the beginning and end of the draft passing by the optical sensor on the conveying surface. The output conveyor comprises a speed signal output that is signal-connected to the control. The control comprises a timer, and the timer times the duration between the beginning and end of the draft as determined by the optical detector. The control calculates the length of the draft using the duration multiplied by the speed of the conveying surface.

Numerous other advantages and features of the present invention will be become readily apparent from the following detailed description of the invention and the embodiments thereof, from the claims and from the accompanying drawings.

BRIEF DESCRIPTION OF THE DRAWINGS

FIG. 8 is a schematic plan view of completed drafts illustrating a desired result and prior art deficiencies.

DETAILED DESCRIPTION OF THE PREFERRED EMBODIMENTS

Figure 1:
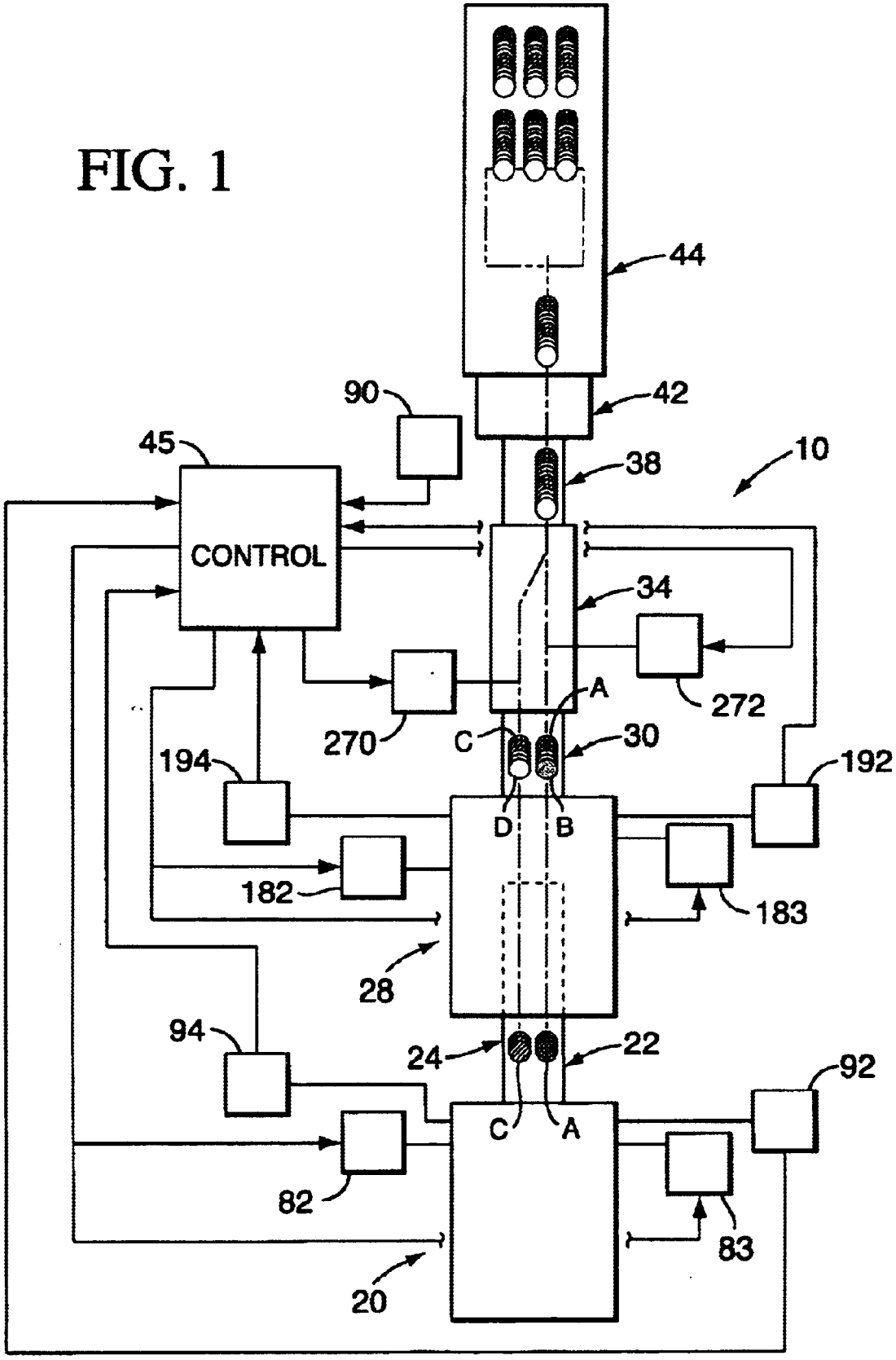
FIG. 1 is a schematic plan view of a slicing and conveying system of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a slicing and conveying system 10 in accordance with an exemplary embodiment of the present invention. The system 10 illustrated is configured to form a four-draft combined draft, of the flavors A, B, C, D. Although it is advantageous that the four flavors A, B, C, D are four different flavors, such is not a requirement. The invention encompasses flavors A, B, C, D which are all different flavors, or where only some are different flavors, or where none are different flavors. It is also possible that some of the flavors A, B, C, D have different shapes or sizes, or other characteristic. It is also encompassed by the invention that the draft D is eliminated and a three-draft elongated combined draft is produced.

The system includes a first, or rear slicing machine 20 which cuts slices from two loaves and deposits the slices on an output conveyor assembly 22 forming shingled stacks or drafts A, C. The output conveyor assembly 22 transports the drafts to a pass-through conveyor 24. The pass-through conveyor 24 delivers the drafts through a rear entrance of a second, or front slicing machine 28. The second slicing machine 28 cuts slices from two additional loaves, which slices are formed in shingled stacks or drafts B, D that are stacked in shingled fashion on top of the drafts A, C respectively, forming a pair of shingled combined drafts A+B and C+D, respectively. The combined drafts are transported on a second output conveyor assembly 30 and onto an overlap conveyor 34. The overlap conveyor 34 realigns the two combined drafts into a single, elongated combined draft A, B, C, D. An overlap conveyor is commercially available as model OL-180 from Formax, Inc. of Mokena, Ill., U.S.A. The elongated combined draft A, B, C, D is then transported on a transfer conveyor 38.

A succession of elongated combined drafts are transferred from the conveyor 38 over a check weight conveyor 42, wherein unacceptable drafts can be rejected and diverted, and acceptable drafts can be moved onto a staging conveyor 44 wherein a single file stream of drafts is rearranged to fill the staging conveyor 44. Such a staging conveyor is described in U.S. Pat. No. 5,810,149 and is commercially available as the A*180 Autoloader from Formax, Inc. of Mokena, Ill., U.S.A.

A control 45, such as a computer or other microprocessor, receives signals from a plurality of draft length sensors, and based on the signals, controls conveyor speeds throughout the system, as described below.

Figure 2A:
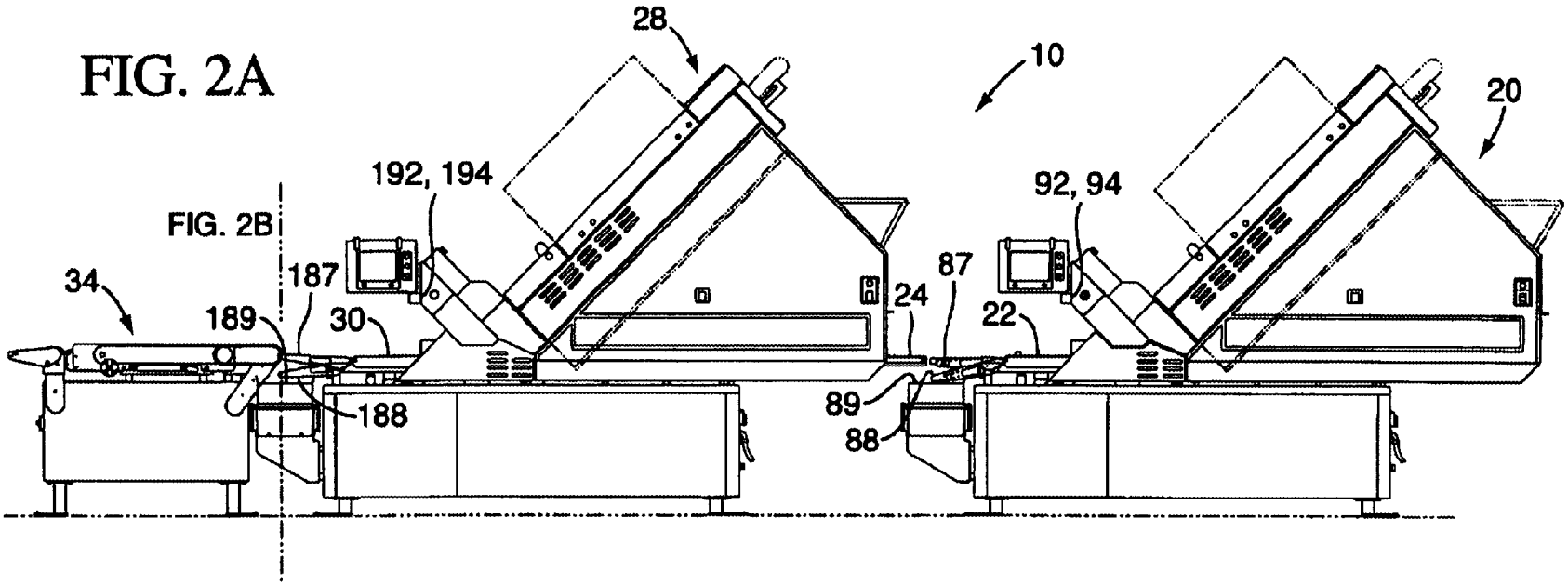
FIG. 2A is an elevational view of the system of FIG. 1.

FIG. 2A illustrates the system 10 having the first and second slicing machines 20, 28. The slicing machines are of a type as described in U.S. Pat. Nos. 5,649,463; 5,704,265; and 5,974,925; as well as patent publications EP0713753 and WO99/08844, herein incorporated by reference. The slicing machines can also be commercially available FORMAX FX180 machines, available from Formax, Inc. of Mokena, Ill., U.S.A.

Figure 2B:
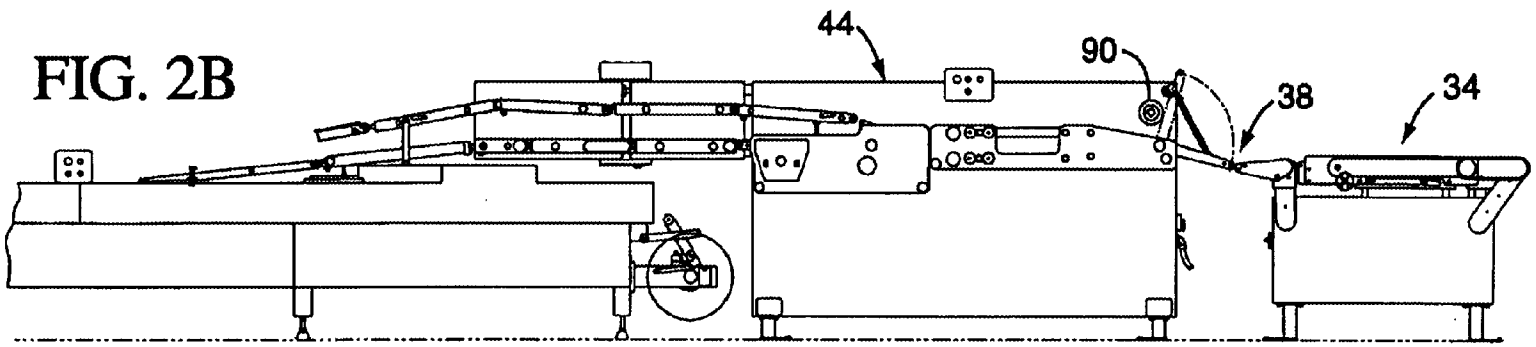
FIG. 2B is a continuation of FIG. 2A.

FIG. 2B illustrates the overlap conveyor 34 which transfers the elongated combined draft to the staging conveyor 44. A sensor 90, such as an optical sensor or photo eye, directs a light beam onto the conveyor 38 to sense and signal a presence of, and a subsequent absence of, the elongated draft. The sensor can be a photo eye with integrated sender and reflection-receiver. The photo eye can have its light beam directed between belts of the conveyor such that no light reflection is received until a draft is positioned beneath the light beam. The photo eye can issue an on or off switch signal that changes state when a reflection is received from the draft. These signals are communicated to the control 45 and timed by the control 45. Given that the control 45 also has the speed of the staging conveyor 44 as an input, the length of the combined draft can be calculated by the control 45, as the product of conveyor speed and the time period between the sensed presence and absence of the elongated draft. For example, if the sensor "sees" product for 0.050 seconds and a known conveyor speed is 108 inches per second, then the draft length would be 5.4 inches.

Figure 4:
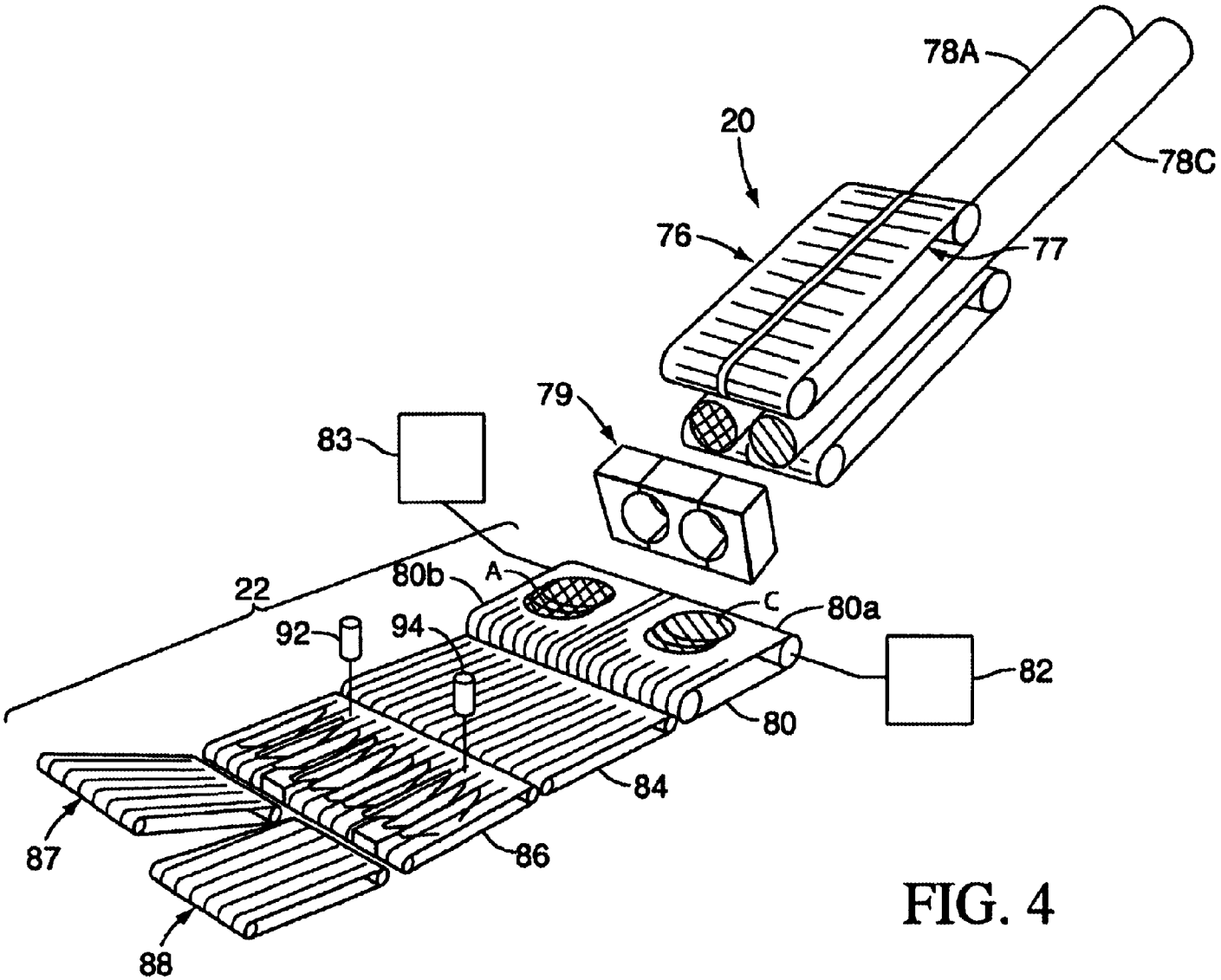
FIG. 4 is a schematic perspective view of a first slicing machine and associated conveyors shown in FIG. 1.

FIG. 4 illustrates the first slicing machine 20 and associated output conveyor assembly 22 in more detail. The slicing machine 20 includes side-by-side independent loaf feed belt assemblies 76, 77. Each belt assembly includes upper and lower circulating belts. The feed belt assemblies 76, 77 continuously feed food loaves 78A, 78C through a slicing orifice assembly 79 where the loaves are sliced by an adjacent rotating blade (not shown). The loaves 78A, 78C are cut into slices which are deposited onto the output conveyor assembly 22, forming shingled drafts of flavors A and C, respectively.

According to the exemplary embodiment, the output conveyor assembly 22 comprises a split jump conveyor 80, an unload conveyor 84, a check weight conveyor 86 and reject conveyors 87, 88. Particularly, the slices are deposited onto the split jump conveyor 80, having conveying surfaces 80*a*, 80*b* which are operated at controlled speeds by precisely-controllable motors 82, 83 to shingle the slices to form the drafts A, C. The precisely-controllable motors 82, 83 are preferably AC servomotors driven by independent servomotor drives that are signal-connected to the control 45. The control 45 sends a speed command signal to the respective servomotor drives. The motors 82, 83 can be mechanically connected to the conveyor as described in U.S. Pat. No. 5,649,463, herein incorporated by reference.

Figure 3A:
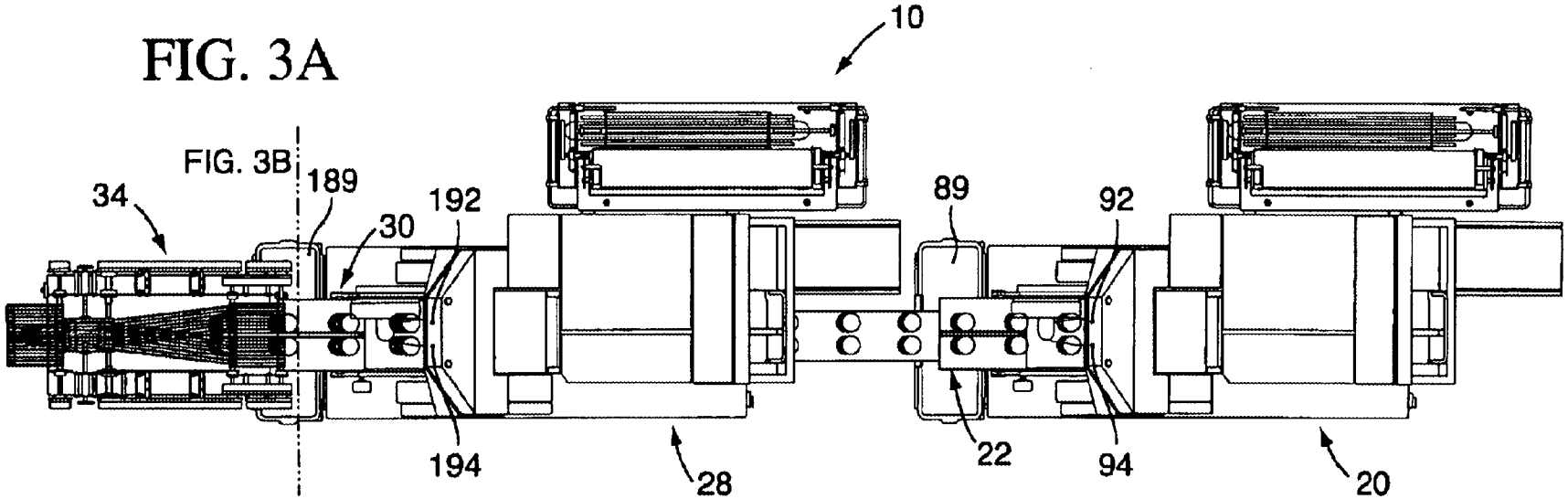
FIG. 3A is a plan view of the system of FIG. 1.
Figure 3B:
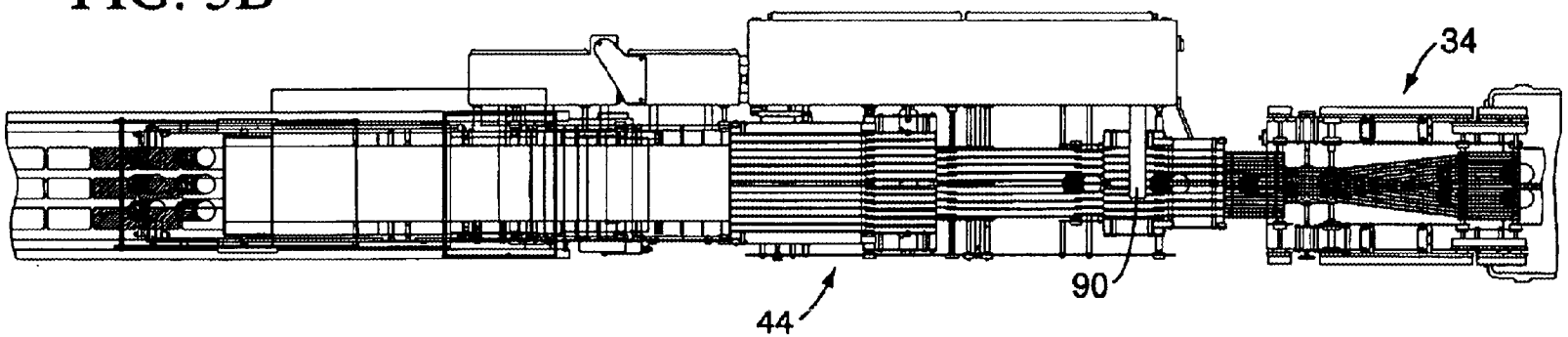
FIG. 3B is a continuation of FIG. 3A.

When the drafts are complete, the jump conveyor surfaces 80*a*, 80*b* are accelerated to space the drafts A, C from succeeding drafts A, C to be passed onto the unload conveyor 84. The unload conveyor 84 deposits the drafts A, C onto the check weight conveyor 86. Depending on the condition or weight of the drafts, unacceptable drafts are transferred by the reject conveyors 87, 88 onto a removal tray or conveyor 89 shown in FIGS. 2A and 3A.

Sensors 92, 94, such as optical sensors or photo eyes, are arranged above the transport direction of the drafts A, C, respectively. In the exemplary embodiment, the sensors 92, 94 are arranged above the check weight conveyor 86. The sensors 92, 94 sense the beginning and end of the shingled drafts A, C moving under light beams from the sensors 92, 94 respectively, and such information is fed to the control 45. The sensors can be photo eyes each with integrated sender and reflection-receiver. Each of the photo eyes can have its light beam directed between belts of the conveyor such that no light reflection is received until a draft is positioned beneath the light beam. The photo eye can issue an on or off switch signal that changes state when a reflection is received from the draft. Given that the control 45 also has the speed of the check weight conveyor 86 as an input, the length of the drafts A, C can be calculated by the control 45, as conveyor speed multiplied by the time period between the sensed presence and absence of the drafts A, C.

The pass-through conveyor 24 transfers drafts A, C from the first slicing machine 20 to the second slicing machine 28. This conveyor is driven by an AC inverter and a drum motor with an internal encoder. The control 45 sends a speed command signal to the AC inverter to control the speed of the motor. There are five optical sensors (not shown) mounted above the pass-through conveyor that signal the second slicing machine that drafts A, C are entering the jump conveyor 180. The optical sensors also monitor the transverse alignment of the drafts A, C. If the drafts are not transversely aligned, the computer will allow extra travel distance on one of the jump conveyor surfaces 180*a*, 180*b* (described below) to transversely align the drafts.

Figure 5:
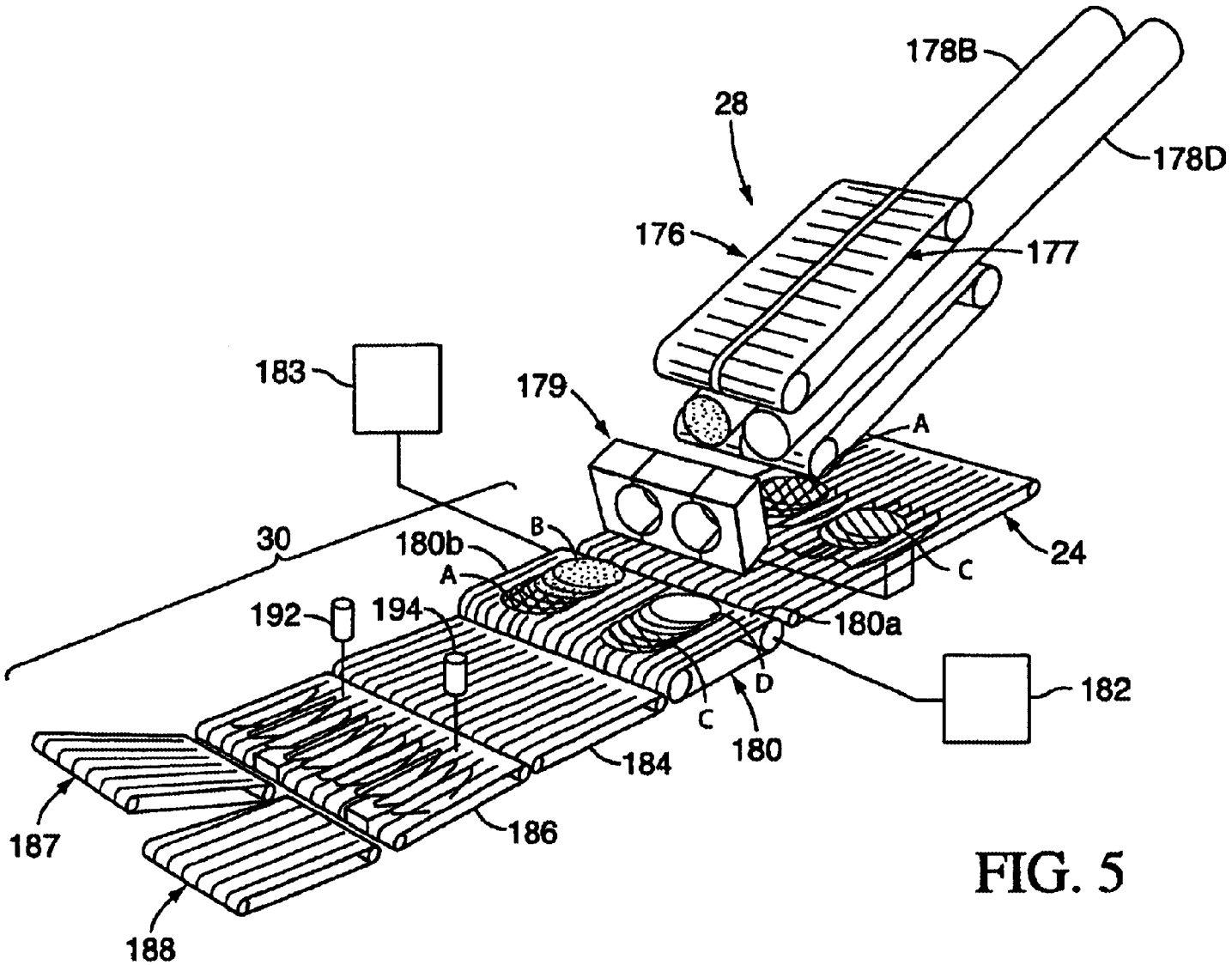
FIG. 5 is a schematic perspective view of a second slicing machine and associated conveyors shown in FIG. 1.

FIG. 5 illustrates the second slicing machine 28 and associated output conveyor assembly 30 in more detail. The slicing machine 28 includes side-by-side independent loaf feed belt assemblies 176, 177. Each belt assembly includes upper and lower circulating belts. The feed belt assemblies 176,177 continuously feed food loaves 178B, 178D through a slicing orifice assembly 179 where the loaves are sliced by an adjacent rotating blade (not shown). The loaves 178B, 178D are sliced into shingled drafts of flavors B and D which are deposited onto the output conveyor assembly 30, forming combined shingled drafts A+B and C+D.

According to the exemplary embodiment, the output conveyor assembly 30 comprises a split jump conveyor 180, an unload conveyor 184, a check weight conveyor 186 and reject conveyors 187, 188. Particularly, the slices are deposited onto the split jump conveyor 180, having conveying surfaces 180*a*, 180*b* which are operated at controlled speeds by precisely-controllable motors 182, 183 to shingle the slices to form the drafts B and D, onto the drafts A and C, respectively. The precisely-controllable motors 182, 183 are preferably AC servomotors driven by independent servomotor drives that are signal-connected to the control 45. The control 45 sends a speed command signal to the respective servomotor drives. The motors 182, 183 can be mechanically connected to the conveyor as described in U.S. Pat. No. 5,649,463, herein incorporated by reference.

When the drafts B and D are complete, the jump conveyor surfaces 180*a*, 180*b* are accelerated to space the drafts A+B and C+D from succeeding drafts A+B and C+D on an unload conveyor 184. The unload conveyor 184 deposits the drafts A+B and C+D onto the check weight conveyor 186. Depending on the condition or weight of the drafts, unacceptable drafts are transferred by the reject conveyors 187, 188 onto a removal tray for conveyor 189 shown in FIGS. 2A and 3A.

Sensors 192, 194, such as optical sensors or photo eyes, are arranged above the transport direction of the drafts A+B and C+D, respectively. In the exemplary embodiment, the sensors 192, 194 are arranged above the check weight conveyor 186. The sensors 192, 194 sense the beginning and end of the shingled drafts A+B and C+D, respectively and such information is fed to the control 45. Given that the control 45 also has as an input, the speed of the check weight conveyor 186, the length of the drafts B, D can be calculated by the control 45, as the product of conveyor speed and the time period between the sensed presence and absence of the combined drafts A+B and C+D. The added draft lengths due to the drafts A and C can be mathematically determined and subtracted.

Figure 6:
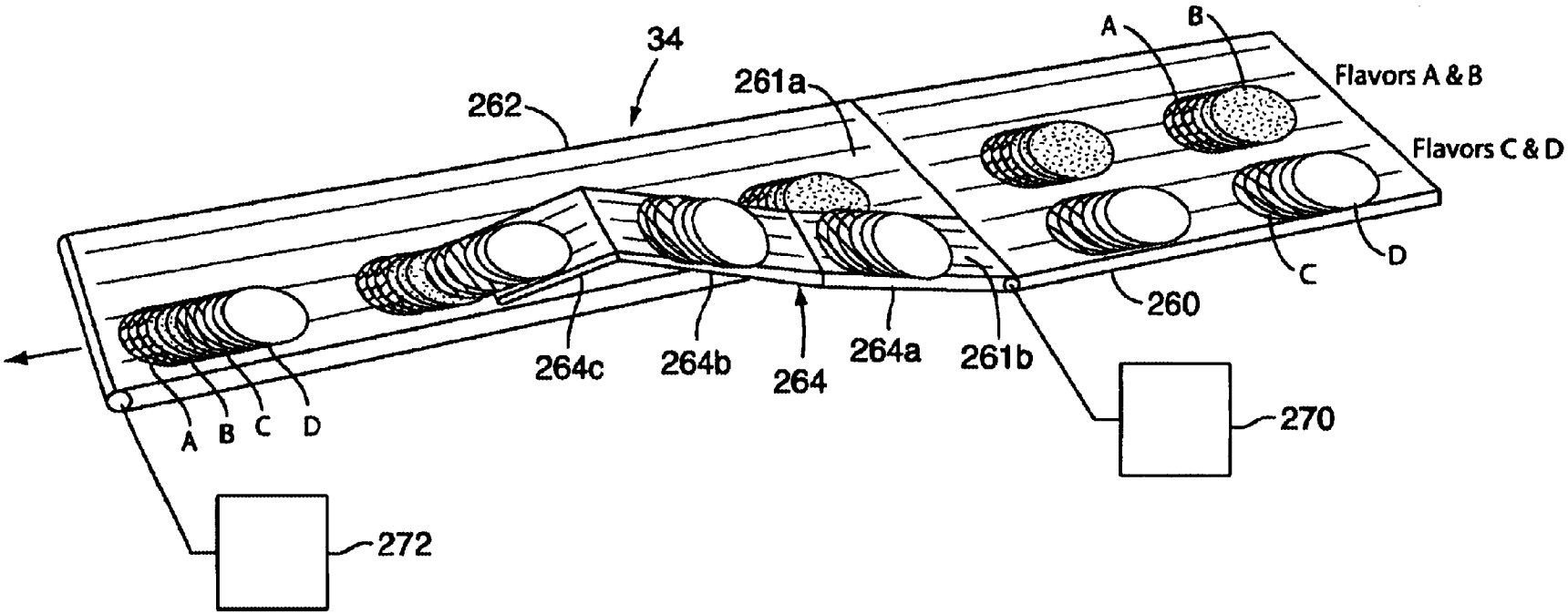
FIG. 6 is a schematic perspective view of the overlap conveyor shown in FIG. 1.

FIG. 6 illustrates the overlap conveyor 34 in more detail. A lead-in conveyor 260 delivers the combined drafts A+B and C+D into longitudinal lanes 261*a*, 261*b*. The drafts A+B are transported along the far side lane 261*a* on a straight-through conveyor 262. The nearside lane 261*b* carrying the drafts C+D includes a crossover conveyor 264 that includes a rising conveyor 264*a*, an angled conveyor 264*b*, and a descending conveyor 264*c*. The path of the crossover conveyor is such that the drafts C+D merge into the lane 261*a* occupied by the drafts A+B on the straight-through conveyor 262. The conveyor speeds are controlled by the control such that the drafts C+D arriving from the descending conveyor 264*c* are stacked on a trailing end of the drafts A, B. The resulting elongated combined draft includes drafts A, B, C, D.

A crossover precisely-controllable motor 270 controls the speed of the crossover conveyor 264 and a straight-through precisely-controllable motor 272 controls the speed of the straight-through conveyor 262. Because the path of the crossover conveyor 264 is longer than the straight-through conveyor 262, the speed of the crossover conveyor must be slightly greater than the straight-through conveyor 262. The precisely-controllable motors 270, 272 are preferably AC servomotors driven by independent servomotor drives signal-connected to the control 45. The control 45 sends a speed command signal to the respective servomotor drives.

Figure 7:
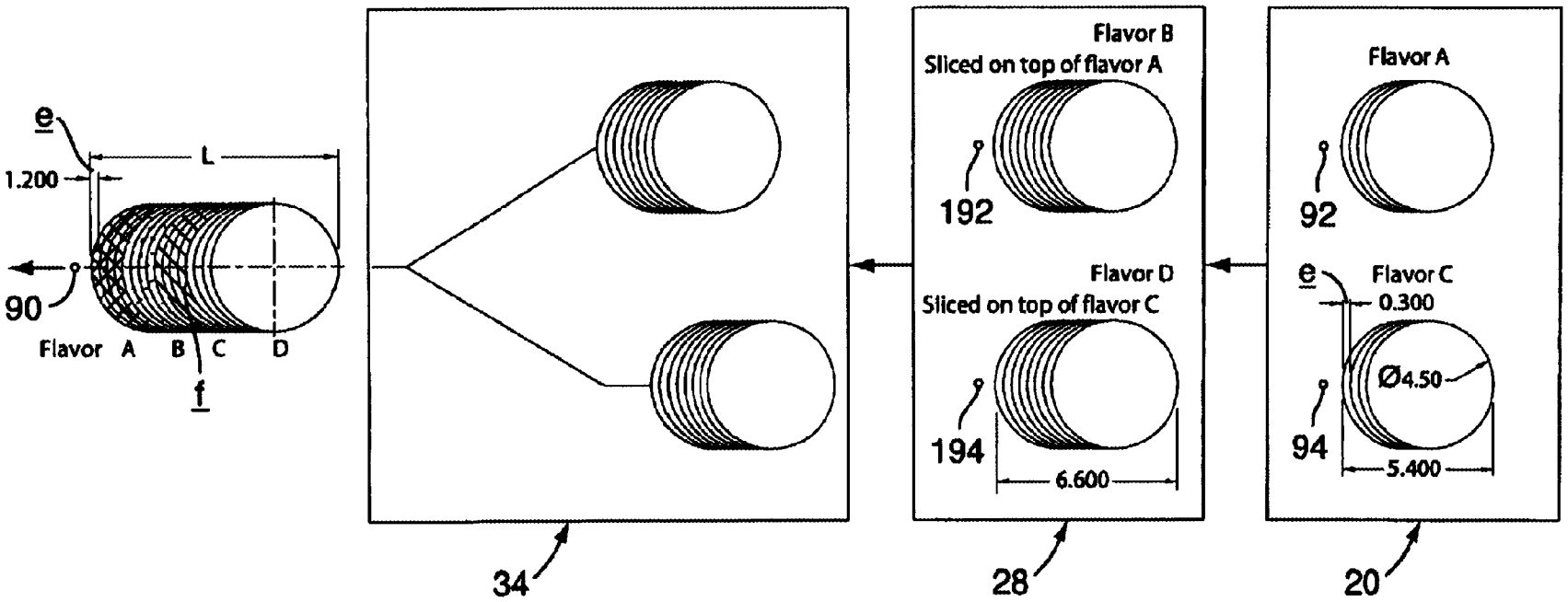
FIG. 7 is a schematic plan view of the system of FIG. 1.

FIG. 7 illustrates in schematic form the operation of the sensors 92, 94, 192, 194, 90 to achieve the advantage that the final combined drafts, that include the four drafts A, B, C, D, are shingled and arranged in a consistent spacing or exposure distance e, with a controlled gap f between drafts, and a consistent length L. Unsightly gaps f between combined drafts A+B and C+D are also minimized. The sensors 92, 94 detect the length of the shingled drafts A and C. The sensors 192, 194 determine the shingled lengths of the combined drafts A+B, and C+D respectively. Given that the length of the drafts A, C are already determined by the sensors 92, 94, the length of the drafts B, D can be derived using subtraction. Given this information, the computer can control the precisely-controllable motor 82, 83, 182, 183 of the jump conveyors 80, 180 to adjust the exposure distance e between slices of the drafts A, B, C, D as necessary. The sensor 90 senses the total length L of the elongated draft that includes all four drafts A, B, C, D.

According to one exemplary method of the invention, the control 45 adjusts the motors 82, 83, 182, 183 and the overlap conveyor motors 270, 272 such that the exposure distance e for each of the drafts A, B, C, D and the gap f are all substantially equal. The length L will equal the length of the last slice of the combined drafts A, B, C or A, B, C, D and the aggregate exposure distances e within each draft and the gap f.

According to another exemplary method of the invention, the drafts A, B, C, or A, B, C, D can have a varying exposure distance e and the gap f can be equal to one of the exposure distances e. For example, if it is desired to maintain equal draft lengths, then the exposure distance within a draft can be adjusted by the control 45 if the loaf for that draft becomes out of round, i.e., the exposure distance can be increased to lengthen the draft. To lengthen the exposure distance the respective jump conveyor speed is increased.

Accordingly, if any draft length is less (or more) than desired, the control will add (or subtract) exposure distance for each slice of that draft. This can be done for each of the three or four drafts.

Additionally, the combined length sensor at the staging conveyor can be used to ensure a desired overall draft length, such as nine inches, by controlling the relative speeds of the straight-through conveyor and crossover conveyor of the overlap conveyor. Slowing the crossover conveyor of the overlap conveyor, with respect to the straight-through conveyor, will increase the length of the combined draft.

The methods can utilize feed forward information from the sensors 92, 94, 192, 194 for the control 45 to control the overlap conveyor motors 270, 272 to compensate for varying draft lengths to ensure the total elongated combined draft length.

The method can use feed back information from the sensor 90 to control the jump conveyor motors 82, 83, 182, 183 and/or the overlap conveyor motors 270, 272 to control overall length L and exposure distance e and the gap f.

Another exemplary control method of the invention provides that the lengths of each draft A, C, A+B, and C+D are measured by the sensors 92, 94, 192, 194 and the control 45 respectively and if any of the lengths varies from the target length, typically 5.4 inches for each of the drafts A and C and 6.6 inches for each of the combined drafts A+B and C+D, the corresponding jump conveyor surface is adjusted by the control to progressively correct the exposure distances e within the draft to achieve the target length. Typically the correction is 30–50 percent of the variance to prevent overcompensation. The combined length sensor 90 measures the length of the elongated combined draft and if the length varies from the target length, typically 9 inches, the control adjusts the overlap conveyor to progressively increase or decrease the gap f to achieve the target length. Typically the correction is 30–50 percent of the variance to prevent overcompensation.

According to another aspect of the invention, the control of exposure distance e within a shingled draft from a slicing machine, using a measured draft length as a feedback signal can be utilized for a single slicing machine, slicing one or more loaves, and is not limited to inline, multiple slicing machine systems. For example, the slicing machine 20 could be used to slice only loaf 78A into draft A, wherein the sensor 92 would feed back draft length information to the control 45 and the movement of the conveying surface 80*b* would be controlled, as described above, via the control 45 and the motor 83, to adjust the exposure distance e of subsequent drafts, to achieve a target length.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A slicing and conveying system for arranging slices from two separate slicing machines, comprising:

a first slicing machine having a rotating slicing blade operable in an effective first cutting plane, and a loaf feed introducing a first loaf into said first cutting plane to form a succession of first slices;

a first output conveyor beneath said first slicing machine for receiving said first slices collected in a succession of shingled first drafts each of first slices, each said first draft being spaced in a longitudinal direction from a preceding first draft and a subsequent first draft;

a second slicing machine having a rotating slicing blade operable in an effective second cutting plane, and a loaf feed introducing a second loaf into said second cutting plane to form a succession of second slices;

a second output conveyor beneath said second slicing machine for receiving said second slices collected in a succession of shingled second drafts of second slices, each said second draft being spaced in a longitudinal direction from a preceding second draft and a subsequent second draft;

a pass-through conveyor receiving said first drafts from said first output conveyor and transferring said first drafts to said second output conveyor, wherein each said second draft is added to one of said first drafts to form a succession of first combined drafts;

wherein one of said first and second slicing machines comprises a third loaf feed for introducing a third loaf into one of said first and second cutting planes to form a succession of third slices collected on one of said first or second output conveyors in a succession of shingled third drafts of third slices, each said third draft being spaced in a longitudinal direction from a preceding third draft and a subsequent third draft; and an overlap conveyor arranged downstream of said second output conveyor, wherein each said first combined draft is transferred onto said overlap conveyor and combined with a third draft on said overlap conveyor to form a succession of elongated combined drafts;

a first length sensor for determining a length of at least one first draft from said first slicing machine;

a second length sensor for determining a length of at least one second draft from said second slicing machine;

a third length sensor for determining a length of at least one third draft; and a control receiving input from said first, second, and third length sensors and outputting a control signal to said first and second output conveyors to control the length of subsequent first, second and third drafts.

2. The system according to claim 1, further comprising a combined length sensor for sensing a length of at least one elongated combined draft; and wherein said combined length sensor is signal-connected to said control, and said control receives input from said combined length sensor and outputs control signals to the overlap conveyor to control the length of a subsequent elongated combined draft.

3. The system according to claim 1, wherein said first length sensor comprises an optical detector which senses the beginning and end of a draft passing by said optical sensor on said first output conveyor; and wherein said second length sensor comprises an optical detector which senses the beginning and end of a draft passing by said optical sensor on said second output conveyor; and wherein said combined length sensor comprises an optical detector which senses the beginning and end of an elongated combined draft passing by said optical sensor after being formed on said overlap conveyor.

4. The system according to claim 1, wherein said first and second output conveyors each comprise a servomotor and a servomotor drive, controlling said servomotor, said servomotor drive signal-connected to said control, said control operable to adjust the speed of the respective output conveyor.

5. The system according to claim 2, wherein said overlap conveyor comprises a straight-through conveyor and a crossover conveyor, said crossover conveyor merging each said third draft with one first combined draft onto said straight-through conveyor, one of said crossover conveyor or said straight-through conveyor comprising a servomotor and a servomotor drive, said servomotor drive controlling said servomotor, said servomotor drive signal-connected to said control, said control operable to change the speed of said servomotor to adjust the relative speeds of said crossover conveyor and said straight-through conveyor to adjust the length of a subsequent elongated combined draft.

6. A method of controlling the length of an elongated combined draft of food slices cut by a plurality of slicing machines, comprising the steps of:

providing a first slicing machine having a rotating slicing blade operable in an effective first cutting plane, and a loaf feed introducing a first loaf into said first cutting plane to form a succession of first slices;

providing a first output conveyor beneath said first slicing machine for receiving said first slices collected in a succession of shingled first drafts of first slices, each said first draft being spaced in a longitudinal direction from a preceding first draft and a subsequent first draft;

providing a second slicing machine having a rotating slicing blade operable in an effective second cutting plane, and a loaf feed introducing a second loaf into said second cutting plane to form a succession of second slices;

providing a second output conveyor beneath said second slicing machine for receiving said second slices collected in a succession of shingled second drafts of second slices, each said second draft being spaced in a longitudinal direction from a preceding second draft and a subsequent second draft;

providing a pass-through conveyor receiving each said first draft from said first output conveyor and transferring each said first draft to said second output conveyor, wherein each said second draft is added to one first draft to form a succession of first combined drafts;

providing that one of said first and second slicing machines comprises a third loaf feed for introducing a third loaf into one of said first and second cutting planes to form a succession of third slices collected on one of said first or second output conveyors in a succession of shingled third drafts of third slices, each said third draft being spaced in a longitudinal direction from a preceding third draft and a subsequent third draft;

providing an overlap conveyor arranged downstream of said second output conveyor, said overlap conveyor having merging paths, wherein each said first combined draft is transferred onto said overlap conveyor and merged with one third draft on said overlap conveyor to form a succession of elongated combined drafts;

sensing a length of at least one first draft from said first slicing machine;

sensing a length of at least one second draft from said second slicing machine;

sensing a length of at least one third draft; and automatically adjusting the speed of at least one of the output conveyors to adjust the length of one of the first, second or third drafts to adjust the length of subsequent first, second and third drafts.

7. The method according to claim 6, comprising the further step of automatically adjusting the relative speed of a crossover conveyor of the overlap conveyor to adjust the length of the elongated combined drafts.

8. The method according to claim 6, comprising the further step of sensing the length of at least one elongated combined draft and adjusting the speed of at least one of the output conveyors.

9. The method according to claim 6, comprising the further step of sensing the length of at least one elongated combined draft and adjusting the relative speed of a crossover conveyor of the overlap conveyor to adjust the length of a subsequent elongated combined draft.

10. The method according to claim 6, comprising the further step of sensing the length of at least one elongated combined draft and adjusting the relative speed of a crossover conveyor of the overlap conveyor and the speed of at least one of the output conveyors to adjust the length of a subsequent elongated combined draft.

11. A slicing and conveying system for arranging slices from a slicing machine, comprising:

a slicing machine having a rotating slicing blade operable in an effective cutting plane, and a loaf feed introducing a loaf into said cutting plane to form a succession of slices;

an output conveyor beneath said slicing machine for receiving said slices, said output conveyor movable to create a succession of longitudinally spaced-apart, shingled drafts of said slices;

a length sensor for determining a length of at least one said draft;

a control receiving input from said length sensor and outputting a control signal to said output conveyor to control the length of a subsequent draft.

12. The system according to claim 11, wherein said output conveyor comprises a conveying surface circulated by a servomotor and a servomotor drive, said servomotor drive controlling said servomotor, said servomotor drive signal-connected to said control, said control operable to adjust the speed of the conveying surface.

13. The system according to claim 11, wherein said output conveyor comprises a conveying surface circulated by a precisely controllable motor;

said length sensor comprises an optical detector arranged above said conveying surface which senses the beginning and end of said one draft passing by said optical sensor on said conveying surface;

said output conveyor comprises a speed signal output that is signal-connected to said control;

said control comprises a timer; and said timer times the duration between the beginning and end of said one draft as determined by said optical detector, said control determining the length of said one draft using the duration multiplied by the speed of the conveying surface.

14. A slicing and conveying system for arranging slices from two separate slicing machines, comprising:

a slicing system having at least one rotating slicing blade operable to slice a first loaf into a succession of first slices and a second loaf into a succession of second slices;

a first output conveyor arranged beneath said slicing system for receiving said first slices in a succession of longitudinally spaced-apart, shingled first drafts;

a second output conveyor arranged beneath said slicing system for receiving said second slices in a succession of longitudinally spaced-apart, shingled second drafts;

an overlap conveyor arranged downstream of said first and second output conveyors, wherein each said first draft is transferred onto said overlap conveyor and combined with one said second draft on said overlap conveyor to form a succession of elongated combined drafts;

a combined draft length sensor for sensing a length of at least one the elongated combined draft; and a control, wherein said combined draft length sensor is signal-connected to said control, and said control receives input from said combined draft length sensor and outputs a control signal to the overlap conveyor to control the length of a subsequent elongated combined draft.

15. The system according to claim 14, further comprising a first length sensor for determining a length of said first draft, said first length sensor signal-connected to said control; and a second length sensor for determining a length of said second draft, said second length sensor signal-connected to said control;

wherein said control receives input from said first and second length sensors and outputs a control signal to said first and second output conveyors to control the length of subsequent first and second drafts.

16. The system according to claim 15, wherein said first length sensor comprises an optical detector which senses the beginning and end of a draft passing by said optical sensor on said first output conveyor; and wherein said second length sensor comprises an optical detector which senses the beginning and end of a draft passing by said optical sensor on said second output conveyor.

17. The system according to claim 15, wherein said first and second output conveyors each comprise a servomotor and a servomotor drive, controlling said servomotor, said servomotor drive signal-connected to said control, said control operable to adjust the speed of the respective output conveyor.

18. The system according to claim 14, wherein said combined draft length sensor comprises an optical detector which senses the beginning and end of an elongated combined draft passing by said optical sensor after being formed on said overlap conveyor.

19. The system according to claim 14, wherein said overlap conveyor comprises a straight-through conveyor and a crossover conveyor, said crossover conveyor merging said first and second drafts onto said straight-through conveyor, one of said crossover conveyor or said straight-through conveyor comprising a servomotor and a servomotor drive, said servomotor drive controlling said servomotor, said servomotor drive signal-connected to said control, said control operable to change the speed of said servomotor to adjust the relative speeds of said crossover conveyor and said straight-through conveyor to adjust the length of a subsequent elongated combined draft.

* * * * *